US007367450B2

(12) United States Patent
Maglione

(10) Patent No.: US 7,367,450 B2
(45) Date of Patent: May 6, 2008

(54) MEMORABILIA SYSTEM AND METHOD

(76) Inventor: Nancy Maglione, 71 Baltusrol Way, Far Hills, NJ (US) 07931

( * ) Notice: Subject to any disclaimer, the term of this patent is extended or adjusted under 35 U.S.C. 154(b) by 397 days.

(21) Appl. No.: 11/083,815

(22) Filed: Mar. 18, 2005

(65) Prior Publication Data

US 2006/0207894 A1 Sep. 21, 2006

(51) Int. Cl.
*B65D 71/00* (2006.01)

(52) U.S. Cl. ..... 206/223; 206/38; 206/278

(58) Field of Classification Search ..... 206/8, 206/83, 38, 223, 232, 278, 570, 575, 576, 206/579, 581, 281.1
See application file for complete search history.

(56) References Cited

U.S. PATENT DOCUMENTS

| | | | | |
|---|---|---|---|---|
| 5,553,702 | A | 9/1996 | Walsh | 206/38 |
| 5,712,005 | A | 1/1998 | Monn | 428/34.1 |
| 5,908,108 | A | 6/1999 | Svopa | 206/223 |
| 6,189,166 | B1 * | 2/2001 | Braine et al. | 5/482 |
| 6,460,279 | B1 | 10/2002 | Stanley et al. | 40/595 |
| 2001/0045367 | A1 * | 11/2001 | Bisbal et al. | 206/223 |
| 2006/0081487 | A1 * | 4/2006 | Hoelzle | 206/223 |
| 2006/0091036 | A1 * | 5/2006 | Casella | 206/457 |

* cited by examiner

*Primary Examiner*—David T. Fidei
(74) *Attorney, Agent, or Firm*—Ernest D. Buff & Associates, LLC; Ernest D. Buff

(57) ABSTRACT

A trunk houses an infant outfit and infant blanket appointed to clothe and swaddle a newborn infant on the momentous journey home from the hospital. Also included by the container are a plurality of cards adapted for documenting the joyous journey. The infant outfit, infant blanket, and cards are safely stored and displayed within the container. A memorabilia system and method are thereby provided for memorializing and commemorating the infant's first journey home from the hospital. The memorabilia system and method are operable to accommodate at least five generations of infant home journeys.

14 Claims, 1 Drawing Sheet

MEMORABILIA SYSTEM AND METHOD

BACKGROUND OF THE INVENTION

1. Field of the Invention

The present invention relates to a memorabilia system and method; and more particularly, to a memorabilia system and method for memorializing a newborn infant's journey home from the hospital.

2. Description of the Prior Art

A newborn infant's first journey home from the hospital is a very joyous and momentous occasion tantamount to other events currently celebrated throughout one's life. For example, Weddings, Christenings, and Communions are all celebrated and memorialized throughout life's journey. These moments call for outfits and keepsakes that are symbolic of the event and are treasured for a lifetime. Accordingly, there are various kits and systems that provide the ritualistic outfits and keepsakes fundamental to these occasions. A newborn infant's journey home from the hospital is an event worthy of special kits and systems as well; however, such kits and systems are wanting. Currently, the occasion is merely memorialized by the few keepsakes parents manage to store away in various keepsake storage containments. Although there are a number of keepsake storage containments and kits available on the market, none of the containments or kits heretofore disclosed and utilized provide an all inclusive kit concentrating on an infant's first journey home.

Many of the keepsake kits heretofore devised and utilized generally comprise a storage and display device that is to be filled with various memorabilia generated as a special event unfolds. In particular, U.S. Pat. No. 5,553,702 to Walsh discloses a keepsake holder that comprises a first housing section, a second housing section, and at least one hinge, at least one keepsake compartment, and retention means received in the keepsake compartment. U.S. Pat. No. 6,460,279 to Stanley, et al. discloses a custom display and storage system that includes an album or scrapbook for two dimensional objects and a display and storage system assembly container for three dimensional objects. U.S. Patent Application Publication No. 2001/0047945 to Scherer discloses a "volume" book-like container set adapted to be utilized for storing memorabilia whereby the "volumes" stand on a shelf as a row of books, whereby the "volume" is entitled with a specific event and contains contents associated therewith. Significantly, none of these patent and patent application publication disclosures provides specific coordinating items that are adapted to be utilized in conjunction with an infant's first journey home from the hospital. Rather, these memorabilia type holders merely provide storage and display cases for a variety of occasions.

"*Acid-free Keepsake Box, Memory Box, and Large Keepsake Boxes*" by ForeverKeeps.com, found at http://www.foreverkeeps.com, discloses a keepsake box composed of acid-free materials. "*Memories of Motherhood Box*" by RedEnvelope, found at http://www.redenvelope.com/re/gifts/product_display/product_information.jsp, discloses a box for storing a mother's memories over the years as her children grow-up. The box comprises a chest, having various compartments therein and a pouch to facilitate the storage of special papers and documents. However, like the patent and patent publications referenced hereinabove, these web site literatures do not provide specific coordinating items that are adapted to be utilized in conjunction with an infant's first journey home from the hospital. Instead, these memorabilia type holders merely provide storage and display cases for a variety of occasions.

Other keepsake kits comprise a storage and display device and various items therein that generally consist of tools and instruments to be utilized in decorating the display and keepsake kit. In particularly, U.S. Pat. No. 5,712,005 to Monn discloses a memory box for storing photos and the like including a kit for decorating so that the contents within the storage box can be readily identified. The disclosed kit includes a storage box for holding and storing sheet objects, an adhesive that is spread-able with a brush and for adhering paper on the outside of the storage box, and instructions. "*The Family Jewels*" by Archival Preservation Co., found at http://www.familyjewelsarchival.com/themebaby.htm, discloses keepsake boxes and textile preservation kits adapted for storing a variety of memorabilia. The kit generally includes a box housing plastic envelopes, acid-free buffered envelopes, tissue paper, instructions, and cotton gloves for the user to wear when handling items placed inside the box. Significantly, the keepsake boxes and kits disclosed by the patent and web literature do not include coordinating memorabilia for celebrating an infant's journey home from the hospital. The disclosed kits merely provide tools for decorating and storing photographs and the like.

Still other keepsake kits comprise a storage and display device and specific items to be utilized in commemorating a special event, but none of these items or events are specifically associated with the journey home from the hospital. In particularly, U.S. Pat. No. 5,908,108 to Svopa discloses an expectant father system comprising a container housing various celebratory items in conjunction with a child's birth. The expectant father system generally comprises a container having a hollow center that houses items such as candy and "It's A Boy" and "It's A Girl" sleeves, which are appointed to be passed out upon the child's birth. However, the '108 patent does not provide specific coordinating items that are adapted to be utilized in conjunction with an infant's first journey home from the hospital.

"*A Baby's Lifelong Journey Kit*" by Baby's Lifelong Treasures, found at http://babysjourneykit.com, discloses a sixteen piece comprehensive keepsake kit that allows for easy and effective organization of information and memorabilia concerning a baby's lifelong journey from infancy to adult life. The kit includes books and the like for recordation and storage of special memorabilia and events. "*Keepsake Gifts*" by This Baby Of Mine, found at http://www.thisbabyofmine.com/keepsakesgifts1.htm, discloses a time capsule kit for an infant. The disclosed time capsule kit is a 22-piece kit and includes an embossed lid that reads "Do Not Open Until", and sets forth an opening date. The 'Time Capsule Keepsake reference's kit includes a book, a how-to guide, a message to the Future® stationery set with matching envelopes, a check list, a certificate and over 160 full-color stickers. "*The Day I Was Born Keepsake Box*" by The Day I Was Born, found at http://www.thedayiwasborn.ie/products/topsellers-1.stm, discloses limited edition keepsake boxes for the years 2003 and 2004. Each keepsake box contains such items as coins, stamps, a newspaper, and a CD single that commensurate the specific year. However, none of these web site literatures provide specific coordinating items that are adapted to be utilized in conjunction with an infant's first journey home from the hospital.

A number of keepsake kits are available on the market as is evidenced by a search of the term "*baby keepsake kit*" on the Internet. In particular, each of "*Baby Keepsake Kit*" by YAHOO! Shopping, found at http://search.shopping.yahoo.com/search and "*Baby Keepsake Kit*" by surprise.com, found at http://www.surprise.com/whositfor/new_parent/baby_keepsake-kit. cfm, lists stores and products that sell baby keepsake kits. The sites reveal numerous baby keepsake kits; but none of the products disclosed therein reveal a coordinating kit for celebrating an infant's journey home from the hospital. Specifically, many of the products are merely impression kits to be utilized to create molds of a baby's hand and/or foot impressions. Other products included scrap-books, craft kits, and an heirloom bonnet kit. Significantly, none of the baby keepsake kits reveals a keep-sake trunk set specifically commemorating a baby's journey home from the hospital.

A newborn infant's journey home from the hospital is an event worthy of special kits and systems as well; however, such kits and systems are wanting. Although there are a number of keepsake storage containments and kits available on the market, none of the containments or kits heretofore disclosed and utilized provide an all inclusive kit concentrating on an infant's first journey home. All of the above patent disclosures are similar and share the same drawbacks. The kits do not disclose a keep-sake coordinated trunk set commemorating a baby's journey home from the hospital, but instead basically discloses a storage system for the storage of general items that are placed therein by the user. Even where the kits disclose items contained within the box, none of the kits provides coordinating memorabilia to be utilized contemporaneously with an infant's journey home from the hospital.

For the foregoing reasons, there exists a need in the art for a memorabilia system and method that provides coordinating items to be utilized when a newborn infant is brought home from the hospital. Specifically, there exists a need in the art for a memorabilia system and method that provides a durable container adapted to house an infant outfit and a coordinating infant blanket to clothe and swaddle a newborn infant as the infant begins his or her journey home and into life. Additionally, there is a need in the art for a memorabilia system and method that further includes a plurality of cards having at least one photograph holder for receiving a photograph, and spaces for recording information wherein the cards are composed of a high quality material and are stored in a heavy weight envelope in the trunk with the infant outfit and the infant blanket. Clearly, a memorabilia system and method for memorializing a newborn infant's journey home from the hospital that is adapted to accommodate a plurality of generations of infants so that the momentous occasion can be memorialized from generation to generation would be highly advantageous. Such a memorabilia system and method for memorializing a newborn infant's journey home from the hospital has not been disclosed or suggested heretofore, and such a memorabilia system and method is not presently available.

SUMMARY OF THE INVENTION

The present invention provides a memorabilia system and method for memorializing a newborn infant's journey home from the hospital. In one embodiment, the memorabilia system includes a trunk having a top portion, a bottom, and side walls constructed to form an interior compartment and an exterior surface. An infant outfit is provided within the interior compartment of the container. An infant blanket and a plurality of cards with accompanying envelopes are also provided within the interior compartment of the container. The infant outfit, infant blanket, and cards are composed of a high quality material. The cards provide spaces for holding photographs and areas for recording information.

The memorabilia system presents an infant outfit, infant blanket, and cards in envelopes that are to be utilized when the newborn infant is being transported home from the hospital for the very first time. The infant outfit, infant blanket, and cards are stored and displayed in the trunk in order to memorialize and commemorate the newborn infant's journey home from the hospital for generations.

In another embodiment, the memorabilia system for memorializing a newborn infant's journey home from the hospital further includes a plurality of cards that are provided within the interior compartment of the container. The cards have at least one space for the recordation of important information associated with newborn infants who wear the outfit and a photograph of the infant. Each of the cards is composed of a high quality material and, optionally, includes a poem or blessing therein.

In still another embodiment, the memorabilia system for memorializing a newborn infant's journey home from the hospital comprises a trunk, an infant outfit, an infant blanket, and a plurality of cards. The trunk has a top portion, a bottom, and side walls constructed to form an interior compartment and an exterior surface. The infant outfit is provided within the interior compartment of the trunk. This infant outfit is composed of a high quality material. The infant blanket is also provided within the interior compartment of the container. The infant blanket is composed of a high quality material, and coordinates with the infant outfit. The cards provided within the interior compartment of the container, have at least one photograph holder for receiving a photograph of each infant who wears the outfit. The cards are composed of a high quality material. At least one space is provided within each card and is adapted for the recordation of important information associated with each newborn infant who wears the outfit. The cards are composed of a high quality material.

The infant outfit, infant blanket, and one of the cards are utilized when the newborn infant is being transported home from the hospital. After use, the infant outfit, infant blanket, and card are stored and displayed in the container in order to memorialize and commemorate the newborn infant's journey home from the hospital. The outfit is then passed on to be worn by future generations of infants.

The top portion and one of the side walls of the container is interconnected by way of a hinge to facilitate an opening and closing motion between the top portion and the interior compartment. The trunk is composed of a heavy duty material, such as wood, plastic, metal, or cardboard, so that the container can be utilized by many generations or years. The memorabilia system is adapted to be utilized to accommodate a plurality of generations of infants, preferably at least five generations of the newborn infants's journeys home from the hospital.

One documentation holder for receiving documents may also be provided. The cards may include a poem or a blessing. Several cards are provided for a plurality of photograph holders and spaces for the recordation of important information, respectively; so that the memorabilia system can accommodate a plurality of generations of newborn infants' journeys home from the hospital. Alternatively, at least five cards provide spaces for the recordation of important information, respectively, so that the memorabilia system can accommodate at least five generations of newborn infants' journeys home from the hospital.

A card will be attached to the outside of the trunk describing the contents. The memorabilia system may further include a hat or bonnet provided within the interior compartment of the container. The hat or bonnet is composed of a high quality material and coordinates with the infant outfit and infant blanket. Additionally, a pair of booties may be provided within the interior compartment of the container. The booties are composed of a high quality material and coordinate with the infant outfit and infant blanket. The outfit may also include hand pockets. Pantaloons for infant girls can additionally be included.

In a preferred arrangement, the memorabilia system's coordinating infant outfit, infant blanket and cards are fashioned for a newborn boy infant. In a second preferred arrangement, the memorabilia system's coordinating infant outfit, infant blanket and cards are fashioned for a newborn girl infant. In a third preferred arrangement, the memorabilia system includes at least two infant outfits within the interior compartment of the container. One of the infant outfits comprises a dress for a newborn girl infant, and the second the infant outfit comprises a pant suit for a newborn boy infant. In yet another embodiment, the cards are not coordinated with other items of the memorabilia system.

The present invention additionally provides a method for memorializing a newborn infant's journey home from the hospital. The method includes constructing a container having a top portion, a bottom, and side walls constructed to form an interior compartment and an exterior surface, wherein the container is composed of a durable material. The method further includes providing an infant outfit, an infant blanket, and a plurality of cards in envelopes within the interior compartment of the container. The infant outfit, infant blanket, and cards are composed of a high quality material. The cards are not necessarily coordinated with one another or with other items of the memorabilia system. The cards within the interior compartment of the container have at least one photograph holder for receiving a photograph and an area for recording information.

The method provides an infant outfit, infant blanket, and a plurality of cards that are utilized when the newborn infant is being transported home from the hospital for the first time. After use, the infant outfit, infant blanket, and cards are stored and displayed in the container in order to memorialize and commemorate the newborn infant's journey home from the hospital for future generations.

Optionally, the method for memorializing a newborn infant's journey home from the hospital further includes providing a plurality of cards within the interior compartment of the container. The cards have at least one space for the recordation of important information associated with the newborn infant. The cards are composed of a high quality material, and contain a space to insert a photograph of the newborn. The card may include a poem or blessing therein. One documentation holder for receiving documents and an album may also be included.

The method for memorializing a newborn infant's journey home from the hospital is adapted to be utilized to accommodate at least five generations of the newborn infants' journeys home from the hospital.

BRIEF DESCRIPTION OF THE DRAWINGS

The invention will be more fully understood and further advantages will become apparent when reference is had to the following detailed description, appended claims, and accompanying drawings, in which

DESCRIPTION OF THE PREFERRED EMBODIMENTS

Figure 1:
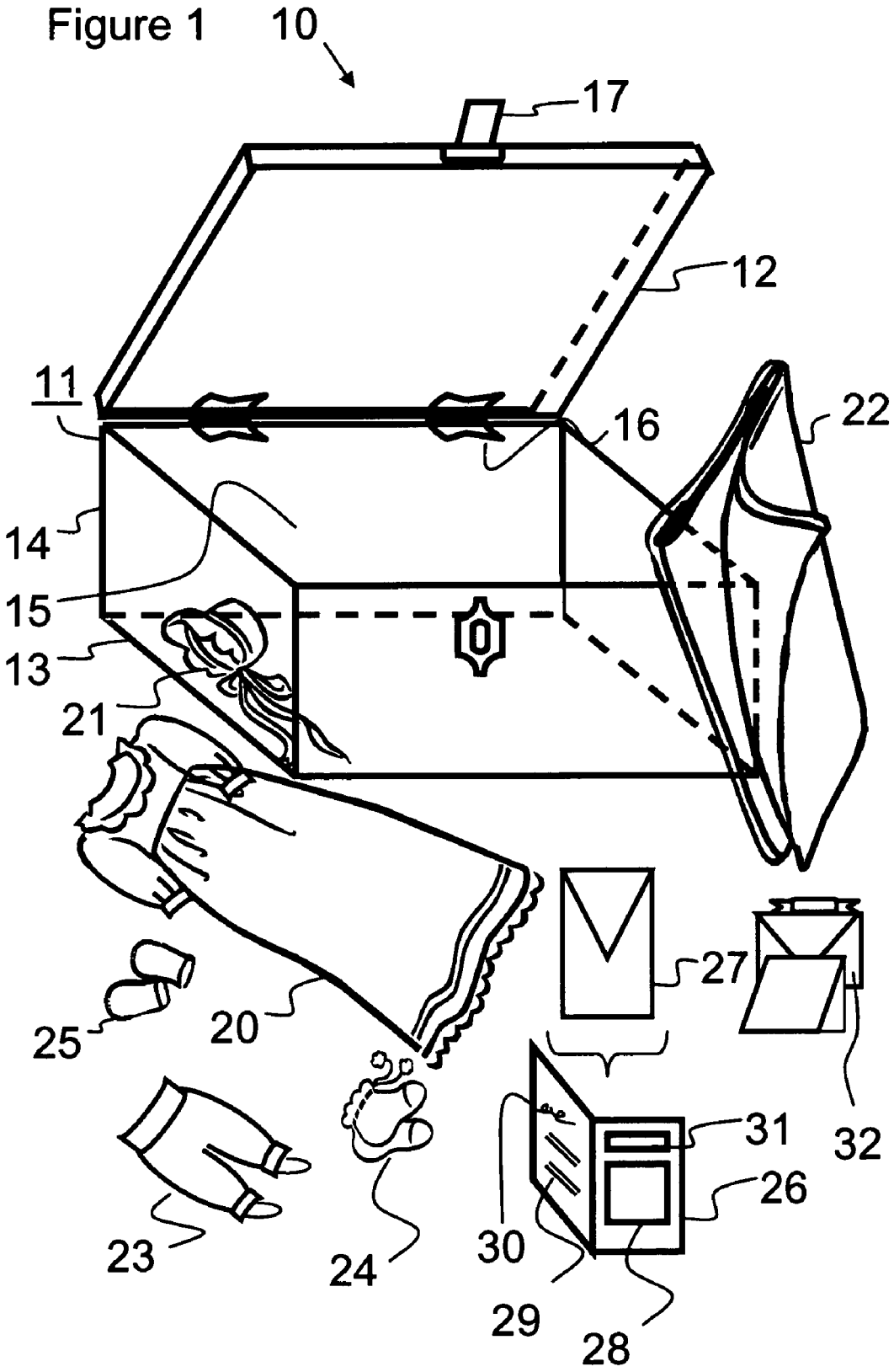
FIG. 1 is a schematic view of the Memorabilia System And Method For Memorializing A Newborn Infant's Journey Home From The Hospital.

The present invention provides a memorabilia system and method for memorializing a newborn infant's journey home from the hospital. Generally stated, the memorabilia system comprises a container that houses an infant outfit and an infant blanket that are appointed to be utilized when a newborn infant is taken home from the hospital after birth. The memorabilia system further comprises a card having at least one photograph holder for receiving a photograph, and space for the recordation of important information associated with the newborn infant. Advantageously, the infant outfit, infant blanket, and card are all constructed of high quality, durable materials so that the memorabilia system can be displayed and is adapted to accommodate a plurality of generations of infants.

FIG. 1 is a schematic view of the Memorabilia System And Method For Memorializing A Newborn Infant's Journey Home From The Hospital shown generally at 10. The memorabilia system includes a trunk 11 having a top portion 12, a bottom portion 13, and side walls 14 constructed to form an interior compartment 15 and an exterior (or outside) surface. The top portion 12 and one of the side walls 14 of the container 11 are interconnected by way of a hinge 16 to facilitate an opening and closing motion between the top portion 12 and the interior compartment 15. The top portion 12 may also include one or more latches 17 that are accommodated by latch holes 18 and locks. The container has a robust construction so that it can withstand years of use without deteriorating. The container is composed of a material such as wood, plastic, metal, or a heavy duty cardboard, so that the container can be utilized for as many as five or more generations or years.

An infant outfit 20 is provided within the interior compartment of the container. The infant outfit 20 is shown here as a dress and matching pantaloons. The infant outfit may be a neutral gender type gown, or may be a gender specific type of wear. That is to say, the infant outfit 20 can be of the type for a newborn infant girl, being a dress and pantaloons 23, or one piece outfit, or the like, and/or being of a feminine color and design. On the other hand, the infant outfit 20 can be of the type for a newborn infant boy, being a pant suit, short suit, one piece outfit or the like, and/or being of a masculine color and design. Optionally, the memorabilia system includes at least two infant outfits 20 provided within the interior compartment of the container. One of the infant outfits is a dress to be worn by a newborn girl infant, and the second infant outfit is a pant suit to be worn by a newborn boy infant. In this manner, and when the infant outfit 20 is of neutral gender, the memorabilia system can be used by parents for all their children, regardless of gender. Furthermore, the infant outfit can be handed down from one family to another, generation after generation.

The infant outfit 20 is composed of a high quality material that is suitable, in terms of comfort and safety, for use with a newborn infant. The infant outfit 20 is composed of a fabric consisting of cotton, cotton blend, linen, silk, cashmere, rayon, blends thereof, or the like. A hat or bonnet 21 or pantaloons 23 may be provided within the interior compartment of the container. The hat or bonnet 21 and pantaloons 23 are composed of the same material as the infant outfit 20 and coordinate with the infant outfit 20. A pair of booties 24 and hand pockets 25 and/or a sweater (not shown) may also be included within the interior compartment of the container. Like the hat or bonnet 21 and pantaloons 23, the pairs of booties 24 and hand pockets 25 are composed of the same material as the infant outfit 20 and coordinates with the infant outfit 20.

An infant blanket 22 is provided within the interior compartment 15 of the container 11. The infant blanket 22 is composed of a high quality material and coordinates with the infant outfit 20. The infant blanket 22 is composed of a fabric consisting of cotton, cotton blend, linen, silk, cashmere, rayon, blends thereof, or the like. Additionally, cards 26 and envelopes 27 are provided within the interior compartment 15 of container 11. The cards 26 have at least one photograph holder 28 for receiving a photograph therein. The cards 26 and envelopes 27 are composed of a high quality material. Optionally, at least one documentation holder 31 for receiving a document therein will be provided.

Five or more cards 26 and envelopes 27 are provided within the interior compartment of the container. The cards 26 have at least one space 29 for the recordation of important information associated with the newborn infant and an area to hold a photograph or a photograph holder 28. The card 26 and envelope 27 are composed of a high quality material. The card 26 may include a poem or blessing 30 therein.

The cards 26 may be provided with a plurality of photographs 28, document holders 31, and spaces 29 for recordation of important information, respectively, so that the memorabilia system 10 can accommodate a plurality of generations of newborn infants' journeys home from the hospital. Preferably, at least five cards 26 are included, providing at least five photograph holders 28, document holders 31, and spaces 29 for recordation of important information, respectively, so that the memorabilia system 10 can accommodate at least five generations of newborn infants' journeys home from the hospital. In an alternative embodiment, the memorabilia system includes an album, which comprises a bound or loose-leaf book having blank pages or some other volume or packet, operative to house a collection of photographs, drawings, specimens, or other relevant documentation in accordance to the infant's journey home. Preferably, the memorabilia system 10 comprises an exterior card and envelope 32 that explains the contents of the container.

The memorabilia system 10 is adapted to be utilized to accommodate at least five generations of newborn infants' journeys home from the hospital. The infant outfit 20, infant blanket 22, cards 26 and envelopes 27, optional bonnet 21, hand pockets 25, booties 24, pantaloons 23, and sweater, are all composed of a durable material and construction that can withstand the testament of time without yellowing or deteriorating. The system may further include transparent vacuum, or "space-saver" bags that constructed in the conventional way with means for drawing a vacuum therewithin. These airtight bags are usable year after year, and function to keep air, dust and odor away from the bag contents. Such vacuum bags are operative to preserve the infant dress, pantaloons, infant blanket, hat, bonnet, hand pockets, or booties which are stored and displayed in the container. One type of vacuum bag that has been found suitable for this purpose is described in detail at www.spacesaverbag.com. By storing the cloth items in this manner, the items remain clean, fresh, and intact over years and years of use and display. These vacuum bags are currently on the market. The memorabilia system's 10 infant outfit 20, infant blanket 22, optional photo album, and card 26 and envelopes 27 can be fashioned or designed for a newborn boy infant, a newborn girl infant, both (i.e. by having at least two outfits, one male and the other female), or gender neutral. All clothing attire and the blanket are to be composed of a natural material and pre-washed to ensure safety and comfort to the newborn infant. The material used is of extremely high quality. It is sized for infants so as to fit almost any baby, so that the keep-sake attire and blanket may be utilized by later generations.

The memorabilia system 10 includes a coordinating infant outfit 20, infant blanket 22, optional photo album, and cards 26 that are utilized when a newborn infant is being transported home from the hospital for the very first time. The infant outfit 20, infant blanket 22, optional album, and cards 26 are stored and displayed in a container, such as a box, trunk, chest, or the like, and preferably a trunk, in order to memorialize and commemorate the newborn infant's journey home from the hospital for generations. The memorabilia system 10 comprises a coordinated container, an infant outfit, a blanket, an optional album, and a plurality of cards and envelopes. In a preferred embodiment, the trunk is coordinated with the infant outfit, blanket, cards, and other elements of the memorabilia system; but in other embodiments, it need not necessarily be coordinated. The memorabilia system 10 provides a keep-sake coordinated gift trunk set that contains memorabilia and clothing to be utilized when a newborn baby is brought home from the hospital for the first time. The exterior surface of the container 11 has a decorative design and is durable in nature. All materials used to construct the container and clothing materials are composed of high quality durable material so that the memorabilia system 10 can be passed from one generation to the next.

The memorabilia system and the contents thereof are intended and suitable for passing from generation to generation. Multiple records of birth places, photographs, and journeys home can be recorded. Specifically, there should be enough cards and optional albums (via photograph holders, etc.) to enable at least five generations of recordation. Each of the containers comprising the Memorabilia Kits can be sold as a coordinated gift trunk made of a heavy weight material that is suitable for storing and displaying the box and contents thereof for many years.

The memorabilia system may be ethnically or religiously orientated to emphasize the baby's ethnic or religious roots. For example, the memorabilia system and or the contents thereof can have elephant embroidery where the baby is of Indian ethnic descent or a shamrock where the baby is of Irish descent, and the like.

Advantageously, the memorabilia system and method for memorializing a newborn infant's journey home from the hospital can be utilized for generation after generation to memorialize and collate infant babies' journeys home. Cultures all over the world recognize important events by wearing special attire. Weddings, Christenings, and Communions, for example, call for outfits that are symbolic of the event and are treasured for a lifetime. A baby's journey home is an event worthy of special attire and remembrance. The memorabilia system and method provides consumers with the ability to commemorate an infant's journey home with outfits that have an heirloom or ethnic appeal, and thereby provide the option of celebrating family lineage or ethnic heritage for generation after generation.

Having thus described the invention in rather full detail, it will be understood that such detail need not be strictly adhered to but that various changes and modifications may suggest themselves to one skilled in the art, all falling within the scope of the invention as defined by the subjoined claims.

What is claimed is:

1. A memorabilia system for memorializing a newborn infant's journey home from the hospital, comprising:

a. a container having a top portion, a bottom, and side walls constructed to form an interior compartment and an exterior surface;

b. an infant outfit provided within said interior compartment of said container;

c. an infant blanket provided within said interior compartment of said container;

d. a card disposed within said interior compartment of said container, and having at least one photograph holder for receiving a photograph and space thereon for the recordation of important information associated with said newborn infant, e. a plurality of transparent vacuum bags disposed within said interior compartment to facilitate the preservation of said infant dress, said infant blanket, and said card;

whereby said infant outfit, infant blanket, and card are appointed to be utilized when said newborn infant is being transported home from the hospital, and stored and displayed in said container in order to memorialize and commemorate said newborn infant's journey home from the hospital for future generations.

2. A memorabilia system for memorializing a newborn infant's journey home from the hospital as recited by claim 1, wherein said top portion and one of said side walls of said container are interconnected by a hinge to facilitate an opening and closing motion between said top portion and said interior compartment.

3. A memorabilia system for memorializing a newborn infant's journey home from the hospital as recited by claim 1, wherein said container is a trunk, and composed of material that comprises wood, plastic, metal, fiber board, glass, or heavy duty cardboard, so that the trunk can be utilized for many generations.

4. A memorabilia system for memorializing a newborn infant's journey home from the hospital as recited by claim 1, wherein said card has at least one documentation holder for receiving a document.

5. A memorabilia system for memorializing a newborn infant's journey home from the hospital as recited by claim 1, wherein said card includes a poem or blessing therein.

6. A memorabilia system for memorializing a newborn infant's journey home from the hospital as recited by claim 1, including a plurality of cards having a plurality of said photograph and document holders, said cards having a plurality of said spaces for the recordation of important information so that said memorabilia system can accommodate a plurality of generations of newborn infants' journeys home from the hospital.

7. A memorabilia system for memorializing a newborn infant's journey home from the hospital as recited by claim 1, including a plurality of cards, for providing at least five of said photograph and document holders, said cards having at least five of said spaces for the recordation of important information so that said memorabilia system can accommodate at least five generations of newborn infants' journeys home from the hospital.

8. A memorabilia system for memorializing a newborn infant's journey home from the hospital as recited by claim 1, wherein said infant outfit and infant blanket are composed of a fabric consisting of cotton, cotton blend, linen, silk, cashmere, rayon, or blends thereof.

9. A memorabilia system for memorializing a newborn infant's journey home from the hospital as recited by claim 1, wherein a hat or bonnet is provided within said interior compartment of said container.

10. A memorabilia system for memorializing a newborn infant's journey home from the hospital as recited by claim 1, wherein a pair of booties is provided within said interior compartment of said container.

11. A memorabilia system for memorializing a newborn infant's journey home from the hospital as recited by claim 1, wherein a sweater is provided within said interior compartment of said container.

12. A memorabilia system for memorializing a newborn infant's journey home from the hospital as recited by claim 1, wherein said infant outfit, infant blanket, and card are fashioned for a newborn boy infant, and said infant outfit is provided with hand pockets.

13. A memorabilia system for memorializing a newborn infant's journey home from the hospital as recited by claim 1, wherein said infant outfit, infant blanket, and card are fashioned for a newborn girl infant, and said infant outfit is provided with hand pockets.

14. A memorabilia system for memorializing a newborn infant's journey home from the hospital as recited by claim 1, wherein there are at least two of said infant outfits provided within said interior compartment of said container, one said infant outfit being a dress and pantaloon for a newborn girl infant, and the second said infant outfit being a pant suit with hand pockets for a newborn boy infant.

* * * * *